United States Patent [19]

Alpaugh

[11] 4,169,261

[45] Sep. 25, 1979

[54] LIQUID LEVEL SENSING APPARATUS

[76] Inventor: F. Nelson Alpaugh, 45 Berrel Ave., Mercerville, N.J. 08619

[21] Appl. No.: 904,036

[22] Filed: May 8, 1978

[51] Int. Cl.[2] ..... H01H 35/00; G08B 21/00

[52] U.S. Cl. ..... 340/602; 200/61.04; 200/61.06; 200/61.2; 340/604; 340/605; 340/618; 340/693

[58] Field of Search ..... 200/61.04, 61.06, DIG. 40, 200/DIG. 14, 61.05, 61.2; 116/69; 340/590, 601, 602, 603, 604, 605, 612, 618, 693, 593

[56] References Cited

U.S. PATENT DOCUMENTS

| | | | |
|---|---|---|---|
| 1,135,798 | 4/1915 | Hirschman | 200/61.04 |
| 1,153,314 | 9/1915 | Keeler | 340/590 X |
| 1,174,827 | 3/1916 | Conway | 200/61.04 |
| 1,201,241 | 10/1916 | Berg | 200/61.04 |
| 1,253,986 | 1/1918 | Larson | 116/69 |
| 2,482,448 | 9/1949 | Wiest, Sr. | 200/61.04 |
| 3,115,557 | 12/1963 | Kjellman | 200/61.06 |
| 3,288,960 | 11/1966 | Miller | 200/61.04 |
| 3,548,137 | 12/1970 | Farrell et al. | 200/61.04 X |
| 3,712,967 | 1/1973 | Carson | 200/61.06 |
| 3,979,569 | 9/1976 | Bilgrei | 200/61.06 X |

*Primary Examiner*—James R. Scott
*Attorney, Agent, or Firm*—Martin Sachs

[57] ABSTRACT

A liquid level sensing apparatus includes a housing having disposed therein circuit means and a power source for providing an indication when the liquid on a surface reaches a predetermined level. The sensing device which activates the circuit means is a disposable liquid disruptable fuse link fabricated from porous paper mounted on the arm portions of a spring means capable of activating the circuit means.

12 Claims, 7 Drawing Figures

LIQUID LEVEL SENSING APPARATUS

BACKGROUND OF THE INVENTION

This invention relates to liquid level sensors and, in particular, to a liquid level sensor capable of sensing predetermined water levels and may be adjusted to a zero level.

The prior art abounds with liquid or water level sensing apparatuses, typically used to perform a function upon the occurrance of the water, such as for example, rain sensing mechanisms as disclosed in the U.S. patents to Keeler, No. 1,153,314 issued Sept. 14, 1915; Hirschman, No. 1,135,798 issued Apr. 13, 1917; and the patent to Conway, No. 1,174,827 issued Mar. 7, 1916. All of the above utilize a porous paper fuse link, which is destroyed upon the absorbtion of water, thereby releasing a spring loaded contact which completes a function e.g. closes a window, activates an alarm, etc. A much later patent to Crockett, Sr., U.S. Pat. No. 4,001,531 issued Jan. 4, 1977 discloses a water-soluble disc element that is disposed proximate a surface. Upon the appearance of water at a given level on the surface, the water soluble disc is caused to dissolve, permitting a spring activated plunger to close the contacts of a switch affixed thereon.

The need for a liquid or water level sensor becomes apparent when one considers the fact that many homes today are provided with basements that are either completed to function as a recreation or study area or are used for storage. In either condition, it is desirous that they be kept dry. Also, frequently, the hot water heater, humidifier or sump pump is located in the basement and an indication of a malfunction as soon as it occurs is most desirable so that protective measures may be undertaken before substantial damage is sustained. Thus, a small, inexpensive portable liquid level sensor is a desirable and necessary item.

The present invention overcomes the shortcomings found in the prior art by providing a liquid level sensor that may be adjusted to a zero level, by being placed in intimate contact with a surface upon which the water is to be sensed, and also may be adjusted to a desired preset water level for other applications.

SUMMARY OF THE INVENTION

Therefore, it is an object of the present invention to provide a liquid level sensing apparatus capable of sensing the presence of small amounts of water appearing on a surface.

It is another object to provide a liquid level sensing apparatus that is capable of sensing a preset level of water appearing on a surface and providing an audible indication thereof.

It is still a further object of the present invention to provide a liquid level sensing apparatus having a disposable liquid disruptable fuse link which is inexpensive to manufacture and is readily installed on the apparatus.

A yet further object of the present invention is to provide an apparatus that is portable and contains its own source of power.

A liquid level sensing apparatus, according to the principles of the present invention, comprises a housing, circuit means disposed within the housing for providing an indication upon activation thereof, spring means disposed upon said housing and having a pair of extending arm portions for activating the circuit means when one of the arm portions is in a rest position. Further included is a liquid disruptable fuse link disposed upon said arm portions for causing displacement thereof from the rest position. The fuse link is disposed in intimate contact with a surface upon which the liquid is to be sensed, the presence of the liquid upon the surface disrupts the fuse link and returns an arm portion to the rest position.

As above objects, as well as further objects and advantages of the present invention will become readily apparent after reading the description of non-limiting illustrative embodiment and the accompanying drawing.

DESCRIPTION OF THE PREFERRED EMBODIMENTS

Figure 1:
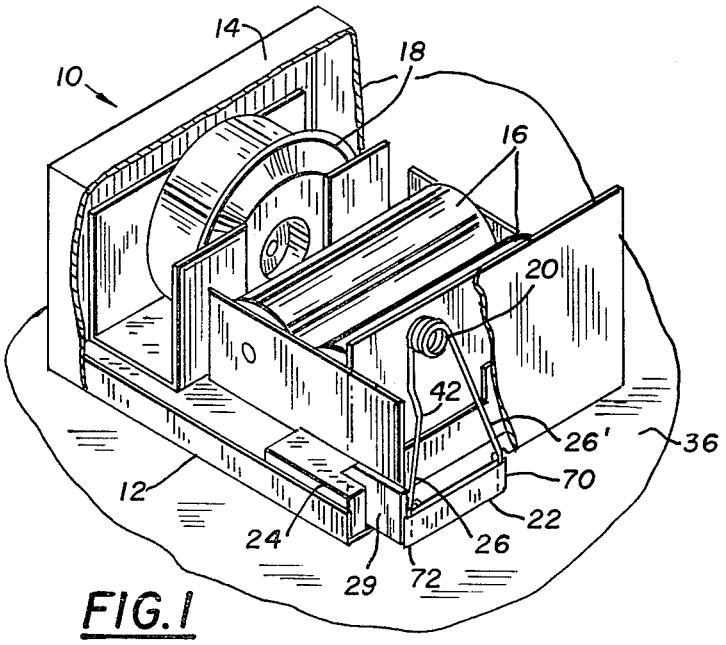
FIG. 1 is an isometric pictorial representation of a liquid level sensing apparatus, according to the principles of the present invention, with the cover broken away to reveal the internal structure.

Referring now to the drawings and, in particular, to FIG. 1, a liquid level sensing apparatus 10, according to the present invention, is provided with a housing or frame 12 and a cover 14 which are used to contain a source of power e.g. batteries 16, an audible indicating device, such as, a low voltage DC activated horn or buzzer 18, an activating spring device 20, upon which is mounted a liquid disruptable fuse link 22, preferably fabricated from a porous paper such as that used for newsprint. The housing 12 may include a microswitch 24 mounted on the housing proximate said activating spring device 20.

The microswitch 24 is of the normally open type. It is urged into its closed position by the arm portion 26 of the activating spring device 20 coming into contact with the arm 29 of the switch 24 when it is in its normal or rest position.

Figure 2:
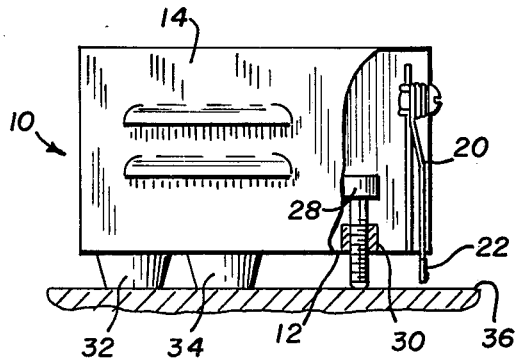
FIG. 2 is a side view, in elevation, of the apparatus of FIG. 1 with the cover broken away to reveal one means for adjusting the height of the housing.

FIG. 2 shows a side view, in elevation, of the apparatus of FIG. 1 with the cover partially broken away to reveal the spring device 20 and a height adjustment screw 28 which is threaded into a mating threaded receptacle 30 affixed to the housing 12. The height adjustment screw 28 functions as one leg support for the housing 12 and cooperates with leg supports 32 and 34 to raise the frame 12 above a surface 36. Rotation of the height adjustment screw 28 permits the housing to be raised or lowered, thus, permitting the fuse link 22 to come into intimate contact with the surface 36 or be raised to any desired level thereabove.

Figure 3:
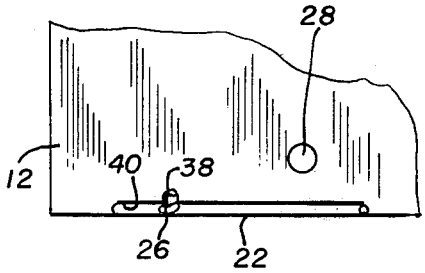
FIG. 3 is a partial bottom view of the apparatus of FIG. 1 showing a detent slot.

FIG. 3 is a partial bottom view of a liquid level sensor provided with a detent slot 38 which is adapted to retain arm 26 of spring device 20 until the fuse link 22 can be assembled thereon, whereupon arm 26 is urged out of detent slot 38 into elongated slot 40 for normal operation. Arm 26 may also be provided with a protrusion 42 (FIG. 1 & FIG. 4) making it more convenient to urge arm 26 into the detent slot 38.

Figure 4:
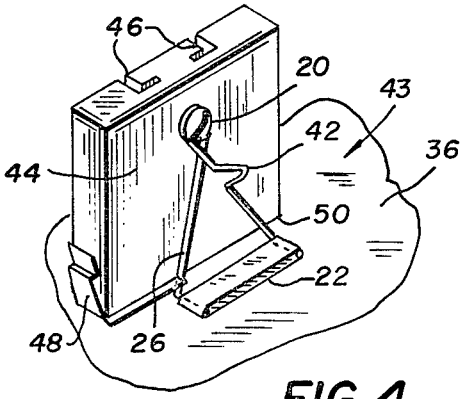
FIG. 4 is an isometric pictorial representation of an alternative embodiment of an activation spring assembly which may be adjusted to sense varying water levels.

FIG. 4 shows an alternative embodiment of a spring activation assembly 43 which includes a spring device 20 affixed to a movable base mounting board 44 in a conventional manner. The board is an insulator and is provided with L-shaped slots 46 which are adapted to cooperate with a mating track or guide, not shown, mounted on the housing 12. Further included on the board 44 is wiper contact 48 which extends below the bottom edge 50 of board 44 and is in intimate contact with the arm portion 26 of the spring device 20. Wiper contact 48 is in continuous electrical contact with the housing 12, which may be used to complete the circuit path, or another electrical contact surface, not shown, to provide the same function. Thus, raising or lowering the board 44 on the track mating with slots 46 will raise or lower fuse link 22 permitting a further means for sensing the liquid level upon or above a surface 36. It is to be noted that link 22 is disposed horizontally with respect to surface 36.

Figure 5:
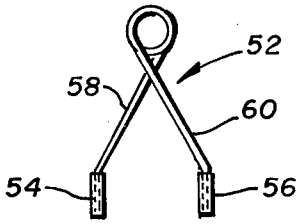
FIG. 5 is a front view of an alternate embodiment of an activation spring.

FIG. 5 discloses an alternative embodiment of an activation spring 52 which includes two cylindrically-shaped porous pads 54 and 56 placed on the tips of arms 58 and 60 of spring 52 which tends to increase the sensitivity of the fuse link 22 to light moisture films such as condensation.

Figure 6:
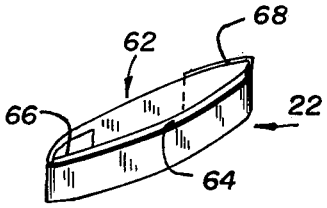
FIG. 6 is an isometric pictorial representation of a liquid disruptable fuse link, according to the principles of the present invention.

FIG. 6 discloses a fuse link 22 which has two paths 62 and 64. Path 62 is preferably provided with a single layer of paper and path 64 is provided with two layers of paper with the end portions 66 and 68 of the link 22 having two layers of paper adapted to fit over and be retained by the tip or ends 70 and 72 of the arms 26 and 26' of spring 20 as shown in FIG. 1.

Figure 7:
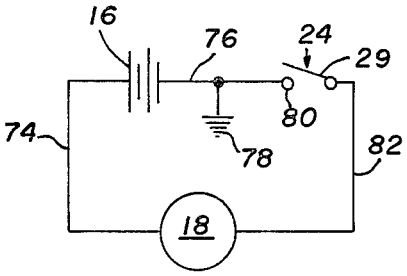
FIG. 7 is an electrical schematic circuit diagram of the apparatus of the present invention.

FIG. 7 is a schematic circuit diagram of the circuit means which will provide one indication when the liquid level has reached the predetermined level. The indication device is a miniature horn or buzzer 18 which has one of its terminals serially connected, via a wire 74, to a source of energy or power, which as shown herein are batteries 16. The other end thereof is connected, via a wire 76 to ground 78, which may be the frame 12, and to switch contact 80, which may be within microswitch 24 or may be wiper contact 48. Spring arm 26 of spring 20 may directly contact the contact 80 or it may contact arm 28 of the microswitch 24 to complete the circuit therebetween. The other arm 26' of spring 20 is connected, via wire 82, to the other terminal of horn 18 thereby completing the series circuit.

In operation the link 22 is placed upon the ends 70 and 72 of spring 20 moving the arms 26 or 26' thereof away from the rest position opening the electrical circuit path at contact 80, thus, removing power from the horn 18. The level of the link 22 above the surface 36 is adjusted to the predetermined set point. Thereafter, when liquid reaches the porous link 22 it disrupts the link 22 permitting the spring 20 to return to its rest position, thereby closing the electrical circuit path and activating the horn 18. Replacing link 22 will reset the liquid level sensing apparatus 10 again.

It is to be noted that although batteries have been shown to activate the indicating device (horn), it is within the scope of this invention to include powering of the indicating means by conventional line voltage. In addition, other types of indicating devices, both local and remote, e.g. light bulbs, etc., are also contemplated.

Hereinbefore has been disclosed a liquid level sensing apparatus capable of sensing liquid from a zero level to a predetermined level. It will be understood that various changes in the details, materials, arrangements of parts and operation conditions which have been herein described and illustrated in order to explain the nature of the invention may be made by those skilled in the art within the principles and scope of the present invention.

Having thus set forth the nature of the invention, what is claimed is:

1. A liquid level sensing apparatus comprising:

(a) a portable housing;

(b) circuit means including internal indicating means disposed within said housing for providing an indication upon activation thereof;

(c) spring means disposed upon said housing and having a pair of extending arm portions, said spring means being coupled to said circuit means for completing a current path therein and activating said indicating means when one of said arm portions is in a rest position; and (d) a liquid disruptable fuse link means disposed upon said arm portions for causing displacement thereof of one of said arm portions from said rest position, said fuse link means being in intimate contact with a surface upon which the liquid appearing thereon is to be sensed, the presence of said liquid disrupting said fuse link and returning said one arm portion to said rest position activating said indicating means.

2. A liquid level sensing apparatus according to claim 1 wherein said liquid is water.

3. A liquid level sensing apparatus according to claim 1 wherein said circuit means includes an internal power source.

4. A liquid level sensing apparatus according to claim 1 further including means for adjusting the height of said extending arm portions and said fuse link means with respect to said surface upon which said liquid is to be sensed.

5. A liquid level sensing apparatus according to claim 1 further including means for adjusting the height of said fuse link means and said housing with respect to said surface upon which said liquid is to be sensed.

6. A liquid level sensing apparatus according to claim 1 wherein said indicating means is a horn or buzzer.

7. A liquid level sensing apparatus according to claim 1 wherein said liquid disruptable fuse link is porous paper and has two layers thereof wrapped around said arm portions with one path between said arm portions having a single layer of paper and the other path between said arm portions having a double layer of paper.

8. A liquid level sensing apparatus according to claim 1 including means for disposing said fuse link horizontally in intimate contact with said surface upon which said liquid appears.

9. A liquid level sensing apparatus according to claim 1 including means for disposing said fuse link on one edge in intimate contact with said surface upon which said liquid appears.

10. A liquid level sensing apparatus according to claim 1 further including reusable detent means for retaining said spring arm portion during replacement of said fuse link.

11. A liquid level sensing apparatus comprising:

(a) a portable housing;

(b) circuit means including internal indicating means disposed within said housing for providing an indication upon activation thereof;

(c) spring means disposed remote from said housing and having a pair of extending arm portions, said spring means being coupled to said circuit means for activating said indicating means when one of said arm portions is in a rest position; and (d) a liquid disruptable fuse link means disposed upon said arm portions for causing displacement thereof from said rest position, said fuse link being in intimate contact with a surface upon which the liquid appearing thereon is to be sensed, the presence of said liquid disrupting said fuse link, and returning said arm portion to said rest position activating said indicating means.

12. A liquid level sensing means according to claim 11 wherein each said spring means extending arm portions additionally include a cylindrically-shaped porous pad disposed beneath said fuse link proximate the ends thereof.

* * * * *